US006704987B1

(12) United States Patent
Miller

(10) Patent No.: US 6,704,987 B1
(45) Date of Patent: Mar. 16, 2004

(54) TOOL USED IN COMBINATION WITH CABLE SECURITY DEVICE

(76) Inventor: Glenn G. Miller, 32 S. 2nd St., Lewisburg, PA (US) 17837

( * ) Notice: Subject to any disclaimer, the term of this patent is extended or adjusted under 35 U.S.C. 154(b) by 0 days.

(21) Appl. No.: 09/549,915

(22) Filed: Apr. 14, 2000

(51) Int. Cl.[7] ..... B25B 27/14

(52) U.S. Cl. ..... 29/280; 29/278; 29/762; 29/758; 29/764; 81/3.55; 81/3.48; 81/177.1; 81/177.2; 81/DIG. 6; 81/177.85; 81/452; 81/453; 279/76; 279/93

(58) Field of Search ..... 29/280, 278, 762, 29/758, 764; 81/3.55, 3.48, 177.1, 177.2, DIG. 6, 452, 453, 177.85; 279/76, 43

(56) References Cited

U.S. PATENT DOCUMENTS 2,517,075 A * 8/1950 Aquila ..... 292/353
3,008,228 A * 11/1961 Crotty ..... 29/280
3,856,190 A * 12/1974 Mole et al. ..... 223/94
4,724,608 A * 2/1988 Parrott ..... 29/280
4,797,798 A * 1/1989 Schumaker et al. ..... 362/413
5,829,896 A * 11/1998 Cain, Jr. ..... 400/491.2
6,279,216 B1 * 8/2001 Halliday et al. ..... 29/280

* cited by examiner

*Primary Examiner*—Richard Chang
(74) *Attorney, Agent, or Firm*—John J. Elnitski, Jr.

(57) ABSTRACT

The present invention is a terminator tool used in combination with a cable security terminator for installing or removing the cable security terminator. The terminator tool includes a handle, a shaft, a retaining pin and a spring member. The shaft is hollow and extends from the handle. The shaft includes a pin hole to receive the retaining pin, a handle end and a terminator end. The handle end is the end inserted and secured into the handle. The terminator end includes two ear slots and receives the spring member. The terminator end is sized to fit into a tool end of the cable security terminator. Ears of the spring member extend from the ear slots of the shaft.

14 Claims, 4 Drawing Sheets

TOOL USED IN COMBINATION WITH CABLE SECURITY DEVICE

Cable security terminators are used in the cable television industry to terminate existing cable ports at or near homes and businesses. The cable security terminator prevents the unauthorized establishing of a link between the cable port and the home or business, without paying the subscription fees. Cable security terminators are designed to require a special tool for installation or removal of the cable security terminator to or from the cable port. The cable security terminator has a cable port end and a tool end. The cable port end is the end which attaches to the cable port. The tool end is the end which receives the special tool to remove or install the cable security terminator. The tool end is a hollow cylinder which is part of a main body and leads to the center of the cable security terminator. Starting at the center of the cable security terminator is a rotatable unit within the main body that screws onto the cable port. One end of the rotatable unit near the tool end is a slotted end which includes two inside slots on an inside surface. The inside slots are for receiving an end of the special tool, which rotates the rotatable unit to screw or unscrew the rotatable unit on or off the cable port. Currently, there are tools on the market which include more than one moving part to mount the tool to the cable security, terminator and require more than one hand movement by the user. More moving parts equates to more chances the tool will break or malfunction. Also, any tool that requires less labor by the user is desirable to the user.

It is an object of the present invention to provide a tool for the removal and installation of a cable security terminator which reduces the amount of moving parts.

It is an object of the present invention to provide a tool which reduces the amount of movement by the user to remove or install a cable security terminator.

SUMMARY OF THE INVENTION

The present invention is a terminator tool for installing or removing a cable security terminator. The terminator tool includes a handle, a shaft, a retaining pin and a spring member. The shaft is hollow and extends from the handle. The shaft includes a pin hole to receive the retaining pin, a handle end and a terminator end. The handle end is the end inserted and secured into the handle. The terminator end includes two ear slots and receives the spring member. The terminator end is sized to fit into a tool end of the cable security terminator. Ears of the spring member extend from the ear slots of the shaft.

DETAILED DESCRIPTION

Figure 1:
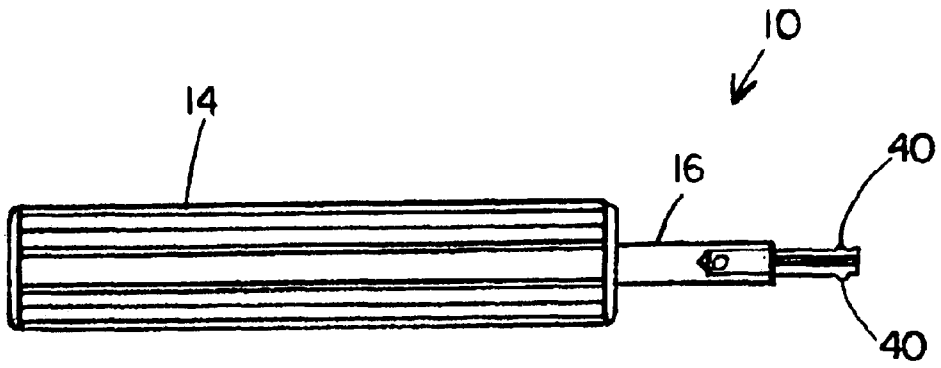
FIG. 1 is a perspective view of a terminator tool according to the present invention.
Figure 2:
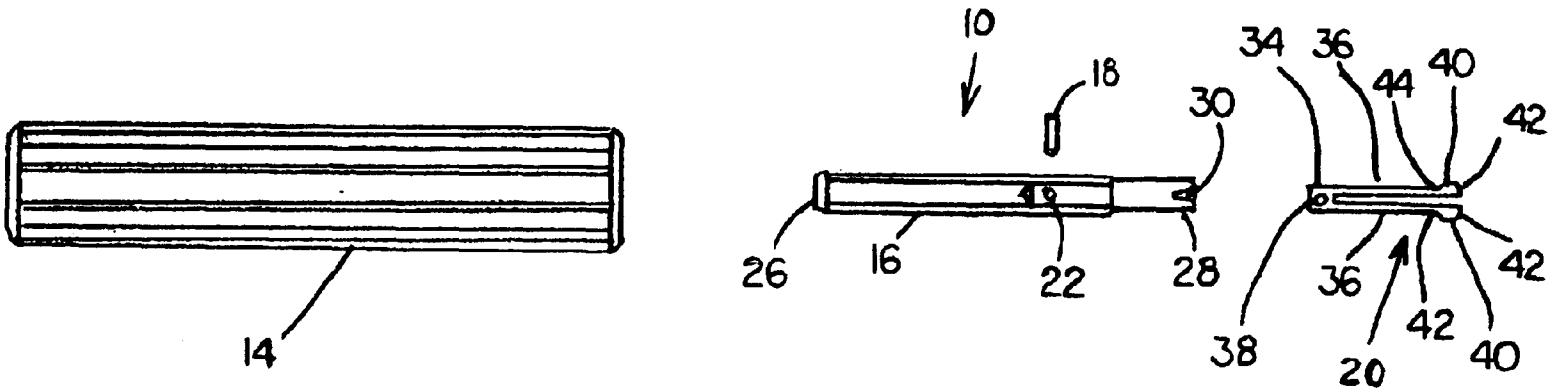
FIG. 2 is an exploded view of a terminator tool according to the present invention.

The present invention is a terminator tool 10 for installing or removing a cable security terminator 12, as shown in FIGS. 1–5. The terminator tool 10 includes a handle 14, a shaft 16, a retaining pin 18 and a spring member 20, as shown in FIGS. 1–2. The shaft 6 is hollow and extends from the handle 14. The shaft 16 includes a pin hole 22 to receive the retaining pin 18, a handle end 26 and a terminator end 28. The handle end 26 is the end inserted and secured into the handle 14. The terminator end 28 includes two ear slots 30. The terminator end 28 is sized to fit into a tool end 32 of the cable security terminator 12. The spring member 20 includes a fastening end 34 and two legs 36. The fastening end 34 includes a fastening hole 38 to receive the retaining pin 18. The two legs 36 extend from the fastening end 34 and each leg 36 includes an ear 40 extending outward from each leg 36. The two legs 36 are flexible in relation to the fastening end 34 and the legs 36 can be flexed toward each other. The spring member 20 is inserted into the terminator end 28 of the hollow shaft 16, until the fastening hole 38 is aligned with the pin hole 22 and the ears 40 slide into the ear slots 30. The retaining pin 18 is inserted into pin hole 22 and the fastening hole 38 to retain the spring member 20 in the shaft 16. The retaining pin 18 is usually of a roll pin variety. The ears 40 are angled or rounded on a front corner 42 and a rear corner 44, so there are no sharp corners on the ears 40. The ears 40 extend outward from the ear slots 30.

Figure 3:
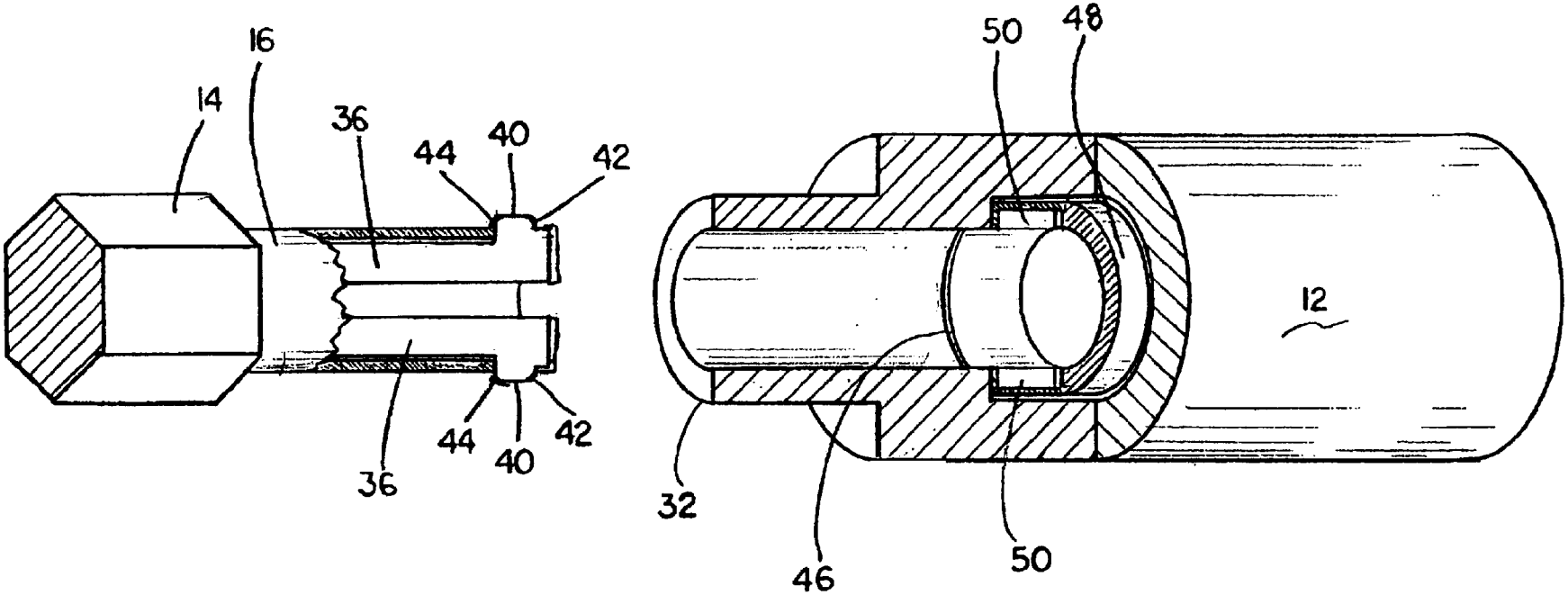
FIG. 3 is a cut-a-way view of a terminator tool before insertion into a cable security terminator according to the present invention.
Figure 4:
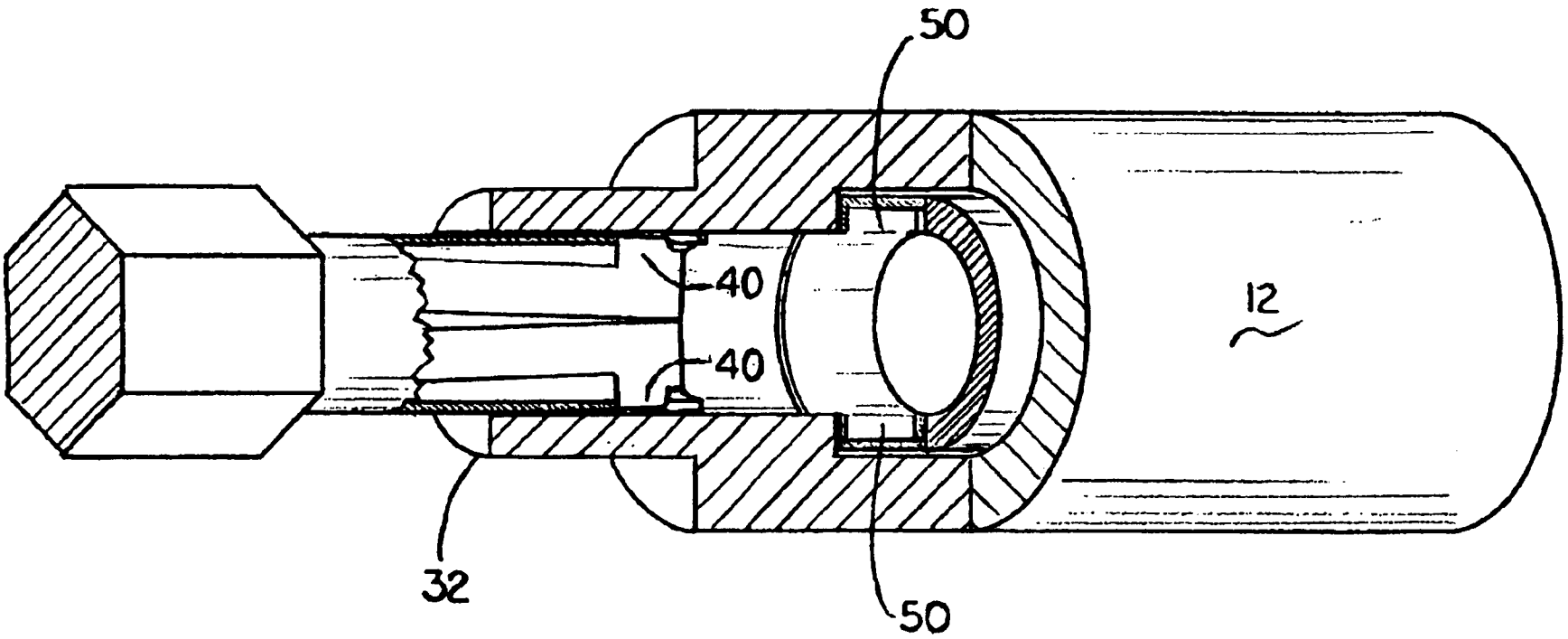
FIG. 4 a cut-a-way view of a terminator tool during insertion into a cable security terminator according to the present invention.
Figure 5:
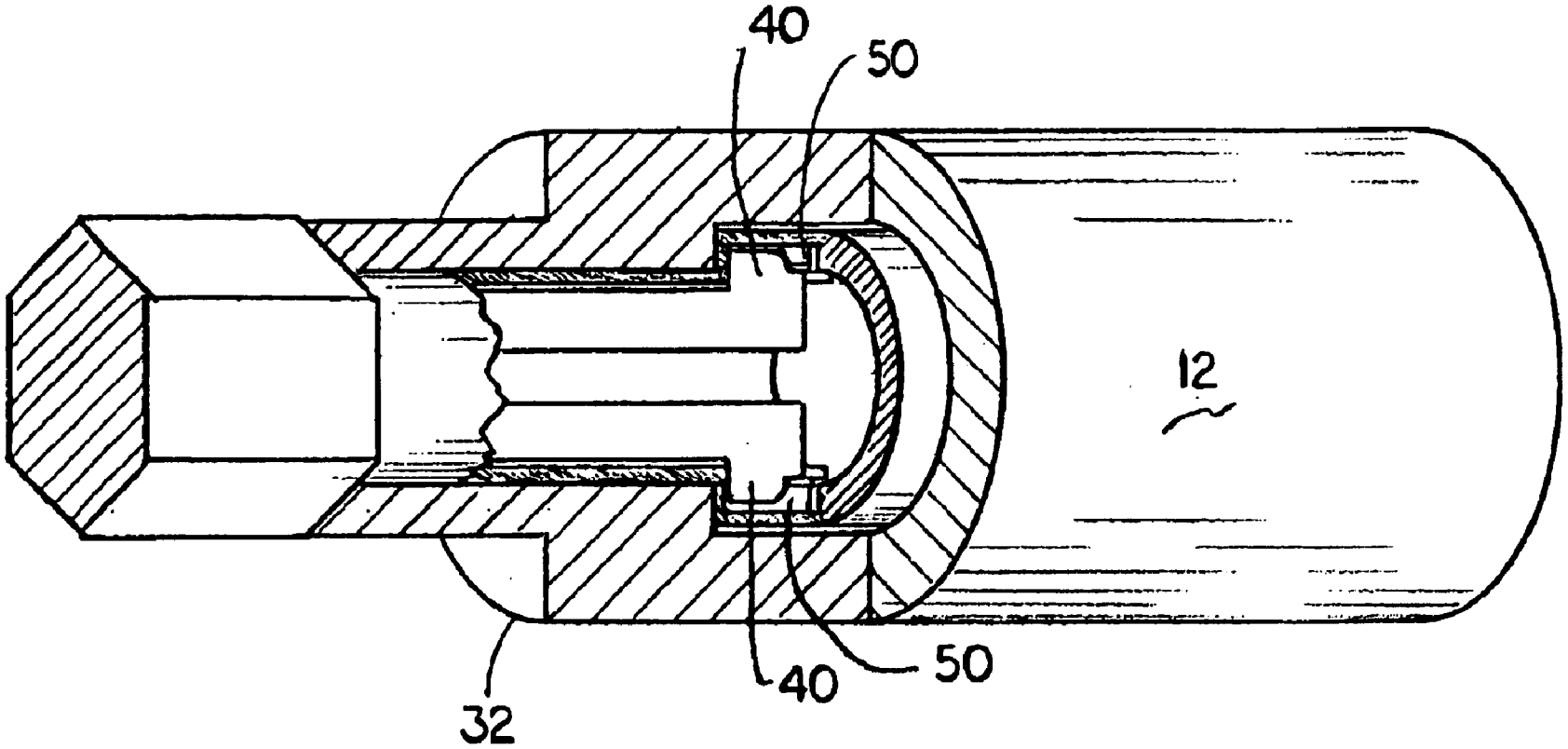
FIG. 5 a cut-a-way view of a terminator tool after insertion into a cable security terminator according to the present invention.

The use of the terminator tool 10 with the Cable security terminator 12 is shown in FIGS. 3–5 and is as follows. The user grasps the handle 14 of the terminator tool 10 and inserts terminator end 28 of the terminator tool 10 into the tool end 32 of the cable security terminator 12. The insertion of the terminator end 28 is allowed due to the shape of the front corners 42 of the ears 40 and the flexing of the legs 36 toward each other, due to the force of pushing the terminator tool 10 in the cable security terminator 12. As the terminator end 28 is initially inserted into the tool end 32, the legs 36 and ears 40 flex toward each other, as the ears 40 are pushed into the shaft 16 due to the contact between the ears 40 and the tool end 32. The terminator tool 10 is inserted until the ears 40 enter into a slotted end 46 of a rotatable unit 48 of the cable security terminator 12 and snap into inside slots 50. Twisting of the terminator tool 10 when the ears 40 are in the slotted end 46 may be necessary to snap the ears 40 into the inside slots 50. Once the ears 40 are in the inside slots 50, the terminator tool 10 is rotated by the handle 14, which in turn rotates the rotatable unit 48, due to the interlocking of the ears 40 and the inside slots 50. To remove the terminator tool 10, the user simply pulls the terminator tool 10 away from the cable security terminator 12. The terminator tool 10 is allowed to be removed due to the shape of the rear comers 44 of the ears 40, in which the force of pulling on the terminator tool 10 forces the legs 36 and ears 40 toward each other and the ears 40 snap out of the inside slots 50.

While different embodiments of the invention have been described in detail wherein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

I claim:

1. A tool, used in combination with a cable security device having a tool end and a connector end, said tool end including an opened end to receive said tool into an inside surface of said tool end and at least one inside slot on said inside surface between said tool end and said connector end, said connector end adapted to attach said cable security device to an object, comprising:

a handle used to rotate, push and pull said terminator tool;

a spring member fixed to said handle such that said spring member rotates with said handle, whereby said handle can be used for insertion, removal and rotation of said spring member internally in said tool end of said cable security device; and at least one ear extending from said spring member on an end of said spring member opposite said handle to engage said at least one inside slot of said cable security device, said at least one ear configured on said spring member such that the rotation of said handle rotates said cable security device on and off said object at said connector end when said at least one car is engaged with said at least one slot, said spring member being flexible to allow said at least one ear to flex away from said inside surface of said tool end during installation of said end opposite said handle into said tool end and to allow said at least one ear to flex into and engage said at least one slot of said inside surface, said at least one ear including a front corner shaped to allow said front corner to engage said inside surface at said opened end of said tool end during insertion under a pushing pressure of said handle to insert said tool into said cable security device and force flexing of said spring member to allow entrance of said at least one ear to engage said at least one inside slot, said at least one ear including a rear corner shaped to allow said rear comer to engage said inside surface at said at least one inside slot during removal under a pulling pressure of said handle to remove said tool from said cable security device and force flexing of said spring member to allow removal of said at least one ear from said at least one inside slot.

2. The tool of claim 1, wherein said spring member includes two ears.

3. The tool of claim 1, wherein said spring member includes a fastening end and two legs, said two legs extending from said fastening end toward said end opposite said handle, each of said legs including one of said at least one ear at said end opposite said handle, and said two legs flexible in relation to said fastening end such that said legs can be flexed away from said inside surface when said ears engage said inside surface during insertion and removal of said tool.

4. The tool of claim 1, further including a shaft extending from said handle and wherein said shaft encases said spring member and said shaft includes a slots for each of said at least one ear to allow said at least one ear to extend from said shaft.

5. The tool of claim 2, further including a shaft extending from said handle and wherein said shaft encases said spring member and said shaft includes a slots for each of said at least one ear to allow said at least one ear to extend from said shall.

6. The tool of claim 3, further including a shaft extending from said handle and wherein said shaft encases said spring member and said shaft includes a slots for each of said at least one ear to allow said at least one ear to extend from said shaft.

7. The tool of claim 4, further including a retaining pin, a pin hole in said shaft and a fastening hole in said fastening end; and wherein said fastening end is placed into said shaft such that said pin hole and said fastening hole are aligned to both receive said retaining pin; and wherein said retaining pin secures said spring member to said tool.

8. The tool of claim 5, further including a retaining pin, a pin hole in said shaft and a fastening hole in said fastening end; and wherein said fastening end is placed into said shaft such that said pin hole and said fastening hole are aligned to both receive said retaining pin; and wherein said retaining pin secures said spring member to said tool.

9. The tool of claim 6, further including a retaining pin, a pin hole in said shaft and a fastening hole in said fastening end; and wherein said fastening end is placed into said shaft such that said pin hole and said fastening hole are aligned to both receive said retaining pin; and wherein said retaining pin secures said spring member to said tool.

10. The tool of claim 3, wherein said spring member includes two ears.

11. The tool of claim 4, wherein said spring member includes two ears.

12. The tool of claim 6, wherein said spring member includes two ears.

13. The tool of claim 7, wherein said spring member includes two ears.

14. The tool of claim 9, wherein said spring member includes two ears.

* * * * *